United States Patent [19]

Kircher et al.

[11] 3,960,697

[45] June 1, 1976

[54] DIAPHRAGM CELL HAVING UNIFORM AND MINIMUM SPACING BETWEEN THE ANODES AND CATHODES

[75] Inventors: Morton S. Kircher, Oakville, Canada; Maynard F. Engler, Cleveland, Tenn.

[73] Assignee: Olin Corporation, New Haven, Conn.

[22] Filed: Feb. 4, 1975

[21] Appl. No.: 547,062

[52] U.S. Cl. ..... 204/252; 204/266; 204/279; 204/296

[51] Int. Cl.[2] ..... C25B 1/10; C25B 1/26; C25B 9/00

[58] Field of Search ..... 204/252, 266, 279, 296

[56] References Cited

UNITED STATES PATENTS

| | | | |
|---|---|---|---|
| 2,944,956 | 7/1960 | Blue et al. | 204/266 |
| 3,477,938 | 11/1969 | Kircher | 204/266 |
| 3,674,676 | 7/1972 | Fogelman | 204/252 X |
| 3,796,648 | 3/1974 | Conner, Jr. et al. | 204/252 X |
| 3,809,630 | 5/1974 | DeNora et al. | 204/266 X |

FOREIGN PATENTS OR APPLICATIONS

| | | | |
|---|---|---|---|
| 700,296 | 12/1964 | Canada | 204/296 |

OTHER PUBLICATIONS

"New Ion Exchange Membrane Vital in Disinfecting Sewage," Product Information Service, DuPont & Co., 12/72.

*Primary Examiner*—John H. Mack
*Assistant Examiner*—A. C. Prescott
*Attorney, Agent, or Firm*—James B. Haglind; Donald F. Clements; T. P. O'Day

[57] ABSTRACT

A diaphragm cell is provided having a continuous net between the anodes and the diaphragm. The continuous net permits the minimum anode-cathode spacing to be employed while maintaining uniform anode-cathode spacing throughout the cell. In addition, the diaphragm is retained and prevented from adhering to the surface of the anodes.

Employing the diaphragm cell of the present invention in the electrolysis of aqueous alkali metal halide brines results in lower electrical energy requirements and reduced operating costs.

18 Claims, 3 Drawing Figures

DIAPHRAGM CELL HAVING UNIFORM AND MINIMUM SPACING BETWEEN THE ANODES AND CATHODES

This invention relates to electrolytic cells for the electrolysis of aqueous salt solutions. More particularly, this invention relates to electrolytic diaphragm cells for the electrolysis of aqueous alkali metal chloride solutions.

Diaphragm-type electrolytic cells are known in the prior art which employ a screen or net between the diaphragm and the electrodes. For example, British Pat. No. 1,336,225, issued Nov. 7, 1973, to Nippon Soda Co, Ltd., teaches the use of a supporting net between the diaphragm and each cathode which is electrically connected to the cathode and which retains the diaphragm. Should the diaphragm tend to swell excessively during cell operation, a net may be placed between the diaphragm and the anode.

U.S. Pat. No. 2,944,956, issued July 12, 1960, to R. D. Blue et al employs a perforated sheet or screen between the diaphragm and the anode. The anode is composed of a graphite block as the back section, composite particles of graphite or carbon as the front section adjacent to the screen and having elements to electrically connect the blocks and the particles. The screen is sized to prevent the graphite particles from plugging the porous diaphragm and has openings between ¼ and ½ inch along the greater dimension. During cell operation, brine flows up through the graphite particles. The anode is designed so that erosion due to brine and gas flow occurs primarily on the graphite particles, thus reducing the frequency of replacement of the graphite block. The spacing between the graphite block and the screen is a minimum of about ¾ of a inch. When the cell is operated to electrolyze alkali metal chloride brines, the graphite particles are eroded, particularly by the formation of $O_2$. Other graphite particles are fed into the cell as replacements. It is difficult, however, to maintain high and consistent current efficiency ratings because of the problems in replacing the graphite particles.

Therefore, there is a need for an electrolytic diaphragm cell in which the diaphragm is retained and prevented from adhering to the anodes while providing a minimum and uniform spacing between the anodes and the diaphragm and the anodes and cathodes.

It is an object of the present invention to provide a diaphragm cell having uniform spacing between the anodes and the diaphragm.

Another object of the present invention is to provide a diaphragm cell in which the diaphragm is effectively prevented from adhering to the anodes.

A further object of the present invention is to provide a diaphragm cell having a minimum spacing between the anode and the cathode.

These and other objects of the invention are accomplished in an electrolytic diaphragm cell comprised of a cell body, a cathode plate having a plurality of cathodes attached, a diaphragm deposited on the cathodes, an anode plate having a pluraity of foraminous metal anodes attached, the anode plate and the cathode plate being sealingly attached to the cell body. Interposed between and contacting the anodes and the diaphragm is a continuous net which spaces apart the anodes and the diaphragm by a uniform distance.

Apparatus described in FIGS. 1–3 when used to electrolyze aqueous solutions of alkali metal halides, such as sodium chloride, produce a halogen gas such as chlorine, hydrogen gas and an alkali metal hydroxide liquor. However, those skilled in the art will recognize that modifications can be made for the use of other starting materials to produce other products.

Accompanying FIGS. 1–3 illustrate the novel electrolytic diaphragm cell of the present invention. Corresponding parts have the same numbers in all FIGS.

Figure 3:
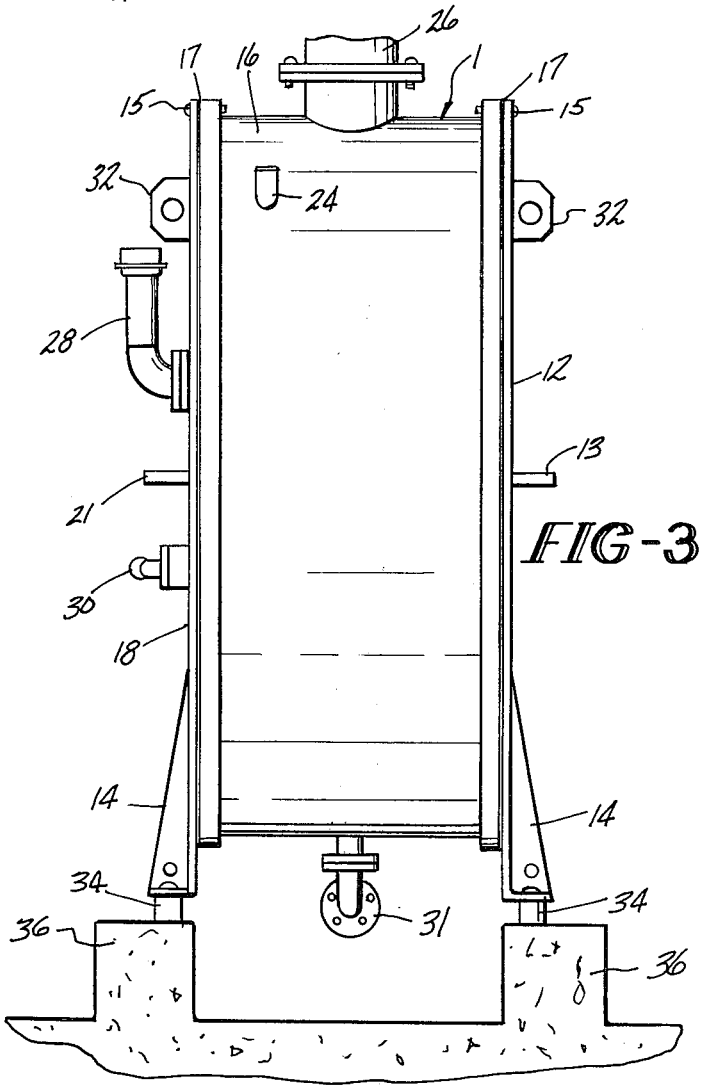

FIG. 3 portrays a side view of one embodiment of the diaphragm cell of the present invention.

Figure 1:
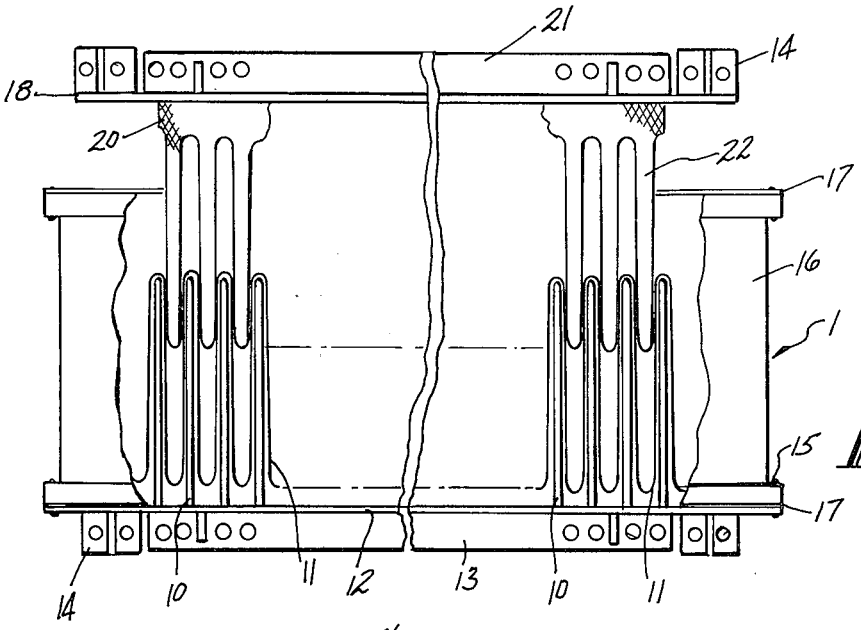
FIG. 1 illustrates a plan view of the electrode sections of the diaphragm cell of the present invention partially assembled.

In FIG. 1, a plan view is illustrated of the electrolytic cell 1 having foraminous metal anodes 10 attached to anode plate 12. Cell body 16 is sealingly attached to anode plate 12 by gasket 17 and bolts 15. Cathodes 20, attached to cathode plate 18, are covered by diaphragm 22. Cathodes 20 are partially inserted between foraminous metal anodes 10. Continuous net 11 covers the surface of foraminous metal anodes 10 which comes in contact with diaphragm 22. Conductor 13, attached to anode plate 12, introduces current to electrolytic cell 1 while conductor 21, secured to cathode plate 18, removes current from the cell. Support brackets 14 are attached to anode plate 12 and cathode plate 18.

Figure 2:
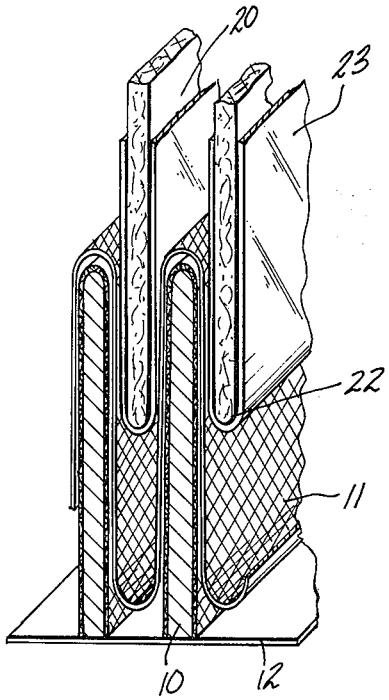
FIG. 2 depicts a partial section in perspective of the anodes and cathodes partially asembled.

FIG. 2 shows a partial section in perspective of anode plate 12 having foraminous metal anodes 10 attached. Continuous net 11 covers anodes 10. Cathodes 20 are partially inserted between anodes 10 and have protective covers 23 positioned between diaphragm 22 and continuous net 11. Protective covers 23 are removed prior to the final assembly of anodes 10 and cathodes 20.

FIG. 3 depicts a side view of assembled electrolytic cell 1 where anode plate 12 and cathode plate 18 are positioned vertically. The aqueous alkali metal halide solution to be electrolyzed enters cell body 16 through brine inlet 24. Halogen gas is removed through halogen outlet 26, hydrogen gas through outlet 28, and caustic liquor through outlet 30. Drain 31 permits the contents of the cell to be removed. Lugs 32 aid in the positioning and removal of anode plate 12 and cathode plate 18. Electrolytic cell 1 is supported by brackets 14 attached to anode plate 12 and cathode plate 18 and bolted to insulators 34 resting on platform 36.

Net 11, which serves as the spacing means between the anodes 10 and the diaphragm 22, is in the form of a continuous sheet which covers all of the anodes in the anode section. In addition to providing spacing between the anodes and the diaphragm, the net prevents the diaphragm from adhering to the anode surface during cell operation. Adherence of the diaphragm to the anode surface results in a reduction of current efficiency. The net is suitably composed of any nonconducting chlorine-resistant material. Typical examples include glass fiber, asbestos filaments, plastic materials, for example, polyfluoroolefins, polyvinyl chloride, polypropylene and polyvinylidene chloride as well as materials such as glass fiber coated with a polyfluoroolefin, such as polytetrafluoroethylene.

Any suitable thickness for the net may be used to provide the desired degree of separation of the anode surface from the diaphragm. For example, nets having thickness of from about 0.003 to about 0.125 of an inch may be suitably used with a thickness of from about 0.010 to about 0.080 of an inch being preferred. Any mesh size which provides a suitable opening for brine flow between the anode and the diaphragm may be used. Typical mesh sizes for the net which may be employed include from about 0.5 to about 20 and preferably from about 4 to about 12 strands per lineal inch. The net may be produced from woven, or non-woven fabric and can suitably be produced, for example, from slit sheeting, or by extrusion.

In covering the anode section, one end of the continuous net is hung over the outer surface of the first anode at one end of the anode section, draped over the intermediate anodes (as shown in FIG. 1) and hung over the outer surface of the last anode in the anode section. While it is not required, if desired, the continuous net may be attached to the anodes, for example, by means of clamps, cords, wires, adhesives and the like.

To further prevent damage to the diaphragm, it may be desirable to cover the diaphragm during a portion of the time the electrolytic cell is being assembled. The diaphragm may have a protective cover such as a sheet or netting which is suitably removed prior to the final assembly of the cell. While a continuous sheet or netting may be used as the protective cover, in a preferred embodiment, a single cover is used for that portion of the diaphragm attached to each cathode. Where the cell is assembled by inserting the cathodes between the anodes and lowering the cathodes, it is necessary to use a removable holding means to retain the protective covers in position during assembly. Any suitable holding means may be used. For example, a rod or slat having a length greater than that of the cathodes is inserted between the cathodes. The protective cover is suitably attached to the holding means, for example, by stapling, tying, or adhesive means. The holding means are removably attached to a pair of supports which are positioned lengthwise across the top and bottom of the cathode section, for example, by tying. When the cathodes have been lowered to a desired position during assembly, the supports, holding means and protective covers are removed. The cathodes are then further lowered to complete the assembly of the electrodes.

The protective cover may be composed of any suitable material such as polyethylene, polytetrafluroethylene, polyvinylidene chloride, waxed paper or the like.

Protective covers are particularly useful where the diaphragm is a material which is deposited on the cathodes such as asbestos.

The anode section covered by the continuous net is comprised of a plurality of foraminous metal anodes attached to the anode plate. Suitable metals of which the anodes are composed include a valve metal such as titanium or tantalum or metals such as steel, copper or aluminum clad with a valve metal. Over at least a part of the surface of the valve metal is a thin coating of a platinum group metal, platinum group oxide, an alloy of a platinum group metal or a mixture thereof. The term "platinum group" as used in this specification means an element of the group consisting of ruthenium, rhodium, palladium, osmium, iridium, and platinum.

The foraminous metal can be in various forms such as a perforated plate or sheet, mesh or screen, or as an expanded metal. The anodes have a planar surface which contains openings, suitably sized to permit the flow of fluids through the anode surface.

In a suitable example, the anode is comprised of two foraminous sections which are spaced apart. The space should be sufficiently large to provide for passage of halogen gas and anolyte and to enclose conductive supports which supply electrical current. Where anodes composed of a single foraminous plate or sheet are used, a space allowance should be made for the flow of fluids.

The anode plate to which the anodes are attached is wholly or partially constructed of electroconductive materials such as steel, copper, aluminum, titanium, or a combination of these materials. Where the electroconductive material can be attacked by the solution or gases in the cell, it can be covered, for example, with rubber, a chemically inert plastic such as polytetrafluoroethylene, a fiber reinforced plastic or a metal such as titanium or tantalum. The anodes are attached to the anode plate by bolting, welding, soldering or the like.

The cathodes comprise a conductive element surrounded by a conductive screen or mesh. The conductive element may be, for example, in the form of a plate or rod having attachment means for the screen or mesh.

A plurality of cathodes are attached to a cathode plate suitably composed at least partially of an electroconductive metal such as copper or steel or a combination of these metals. To avoid corrosive damage, the cathode plate may be covered, for example, with hard rubber, a plastic such as polytetrafluoroethylene or a fiber-reinforced plastic. The cathodes are attached to the cathode plate by any suitable means, for example, by welding or bolting.

The diaphragm covering the cathodes is composed of an inert material which is fluid permeable and halogenresistant. Suitable diaphragm materials include asbestos, reinforced asbestos and polymers with microporosity, or ion exchange properties.

Ion exchange resins which can be used as diaphragm materials include fluorocarbons having the formula:

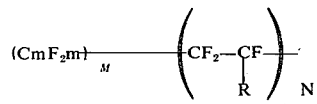

where m is from 2 to 10, the ratio of M to N is sufficient to provide an equivalent weight of from 600 to 2,000, and R is chosen from the group consisting of:

A,

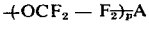

where p is from 1 to 3, or

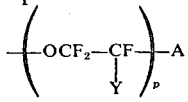

where p is from 1 to 3 and Y is —F, or a perfluoroalkyl group having from one to 10 carbon atoms, where A is an acid group chosen from the group consisting of:

$SO_3H$,
$CF_2SO_3H$,
$CCl_2SO_3H$,
$R'SO_3H$,
$PO_3H_2$,
$PO_2H_2$,
COOH, and

R'OH

Where R' is an aryl group.

Preferred ion exchange resins are those in which R is $SO_3H$ or $OCF_2—CF_2—SO_3H$.

Where the ion exchange resin is a polymer, the fluorocarbon moiety is a polyfluoroolefin such as tetrafluoroethylene, hexafluoropropylene, octafluorobutylene and higher homologues.

A preferred diaphragm material is a composite membrane comprised of a solid fluorocarbon polymer reinforced by a screen of a suitable metal or fabric such as a polyfluoroolefin cloth. The solid fluorocarbon polymers are prepared by copolymerizing, for example, tetrafluoroethylene with a sulfonated perfluorovinyl ether, such as that having the formula $FSO_2CF_2CF_2OCF(CF_3)CF_2OCF=CF_2$. The perfluorocarbon polymers are prepared by copolymerizing the vinyl ether with the tetrafluoroethylene followed by converting the $FSO_2$ groups to a $—SO_3H$ or a sulfonate group (such as an alkali metal sulfonate) or a mixture thereof. The equivalent weight of the perfluorocarbon copolymer ranges from about 900 to about 1600 and preferably from about 1100 to about 1500. The equivalent weight is defined as the average molecular weight per sulfonyl group. The perfluorocarbon polymers may be prepared by methods described in U.S. Pat. Nos. 3,041,317; 3,282,875 and 3,624,053. A particularly preferred diaphragm material is a perfluorocarbon polymer composite membrane produced by E. I. DuPont de Nemours and Company, and sold commerically under the trademark "Nafion".

The spacing between the anode and the cathode is comprised of a thicknesses of the diaphragm and the continuous net. This spacing is from about 0.010 to about 0.500 and preferably from about 0.030 to about 0.250 of an inch. Of this amount, from about 0.007 to about 0.375, and preferably from about 0.020 to about 0.170 of an inch represents the thickness of the diaphragm.

The design of the diaphragm cell of the present invention may be any suitable type including, for example, those types illustrated by U.S. Pat. Nos. 1,862,244; 2,370,087; 2,987,463; 3,247,090; 3,477,938; 3,461,057; 3,617,461; and 3,642,604, provided foraminous metal anodes are employed. A preferred cell structure is a diaphragm cell in which the anodes and cathodes are mounted on electrode plates which are positioned vertically. A cell of this type is described in U.S. Pat. No. 3,477,938. A particularly suitable cell is the type described in U.S. pat. application 411,327, filed Oct. 31, 1973, by M. S. Kircher and E. N. Macken. In this design, the cell body is in the form of a shell having openings at each end. Cell bodies may be in the form of a rectangle, cylinder or ellipse and may be constructed of a variety of materials such as fiber-reinforced plastic, hard rubber, steel, hard rubber-line steel, titanium, asbestos, reinforced plastic or concrete. Where the shell is steel or concrete, it may be lined with a protective coating such as rubber, ceramic tile composites, plastics reinforced with asbestos, carbon, silica, or glass fibers, or polyhaloolefin plastics such as polytetrafluoroethylene, or polychlorotrifluoroethylene.

The cell body may be of any conveneient height, for example, a cell body of from about 1 to about 15 and preferably from about 4 to about 12 feet may be employed. To facilitate attachment of electrode plates to the openings to each end of the cell body, the cell body may have a flange surrounding the opening at each end.

The electrode plates are sealingly attached to the openings at the ends of the cell body by any convenient attachment means such as bolts, tie rods or clamps.

As shown in FIG. 3, depicting the assembled cell, the electrode plates are positioned vertically and provide support means for the cell body.

Employing the diaphragm cell of the present invention permits a minimum spacing to be used between the anodes and the cathodes which results in lower electrical energy requirements and reduced operating costs. In addition, by employing the continuous net between the anodes and the diaphragm, the diaphragm is retained and prevented from adhering to the anode surface, maintaining high current efficiency during cell operation. Further, erosion of the diaphragm by gas and liquid flow is reduced.

What is claimed is:

1. A diaphragm cell comprising a cell body, a cathode plate having a plurality of cathodes attached, a diaphragm deposited on said cathodes, an anode plate having a plurality of foraminous metal anodes attached, said cathode plate and said anode plate being sealingly attached to said cell body, and a continuous net interposed between and contacting said anodes and said diaphragm, said net spacing apart said anodes from said diaphragm by a uniform distance.

2. The diaphragm cell of claim 1 in which said continuous net is comprised of a material selected from the group consisting of glass fibers, asbestos filaments, plastic materials selected from the group consisting of polyfluoroolefins, polyvinyl chloride, polypropylene, polyvinylidene chloride, and glass fibers coated with said plastic materials.

3. The diaphragm cell of claim 1 in which said diaphragm is composed of a material selected from the group consisting of asbestos, fluorocarbon ion exchange resins, polyfluoroolefins, and copolymers of polyfluoroolefins with sulfonated perfluorovinyl ethers.

4. The diaphragm cell of claim 3 in which said diaphragm is asbestos.

5. The diaphragm cell of claim 2 in which said diaphragm is a composite membrane comprised of a perfluorocarbon polymer reinforced by polyfluoroolefin cloth.

6. The diaphragm cell of claim 3 in which said foraminous metal anodes comprise a valve metal coated over at least a part of its surface with a platinum group metal, platinum group metal oxide, an alloy of a platinum group metal or a mixture thereof.

7. The diaphragm cell of claim 6 in which the spacing between said anode and said cathode is from about 0.010 to about 0.500 of an inch.

8. The diaphragm cell of claim 5 in which said cell body is a shell having openings at each end.

9. The diaphragm cell of claim 8 in which said cathode plate and said anode plate are positioned vertically and said cathode plate and said anode plate provide support means for said cell body.

10. The diaphragm cell of claim 9 in which said continuous net has a thickness of from about 0.003 to about 0.125 of an inch.

11. The diaphragm cell of claim 10 in which said spacing between said anode and said cathode is from about 0.030 to about 0.250 of an inch.

12. The diaphragm cell of claim 11 in which said continuous net has a thickness of from about 0.010 to about 0.080 of an inch.

13. The diaphragm cell of claim 12 in which said continuous net has a mesh size of from about 0.5 to about 20 strands per lineal inch.

14. The diaphragm cell of claim 13 in which said continuous net is comprised of glass fibers coated with a polyfluoroolefin.

15. A method for assembling an electrolytic cell for the electrolysis of an aqueous alkali metal halide brine which comprises:

a. attaching a plurality of foraminous metal anodes to an anode plate, b. sealingly attaching a cell body to said anode plate, c. inserting a net to cover said anodes, d. attaching a plurality of cathodes to a cathode plate, e. attaching a diaphragm to said cathodes, f. positioning said cathode plate adjacent to said cell body, g. inserting said cathodes between said anodes, h. contacting said anodes and said diaphragm with said net to space apart said anodes from said diaphragm by a uniform distance, i. sealingly attaching said cathode plate to said cell body, and j. positioning said anode plate and said cathode plate vertically.

16. The method of claim 15 in which prior to step d, said diaphragm is covered by a protective cover.

17. The method of claim 15 in which said net is a continuous sheet covering said anodes.

18. The method of claim 16 in which prior to step f, said protective cover is removed.

* * * * *